US008439168B2

(12) United States Patent
Kondo et al.

(10) Patent No.: US 8,439,168 B2
(45) Date of Patent: May 14, 2013

(54) ELEVATOR SYSTEM HAVING BRAKE CONTROL

(75) Inventors: Rikio Kondo, Tokyo (JP); Hiroshi Kigawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 283 days.

(21) Appl. No.: 12/810,313

(22) PCT Filed: Dec. 27, 2007

(86) PCT No.: PCT/JP2007/075057

§ 371 (c)(1),
(2), (4) Date: Oct. 4, 2010

(87) PCT Pub. No.: WO2009/084076

PCT Pub. Date: Jul. 9, 2009

(65) Prior Publication Data

US 2011/0011681 A1 Jan. 20, 2011

(51) Int. Cl.
*B66B 1/28* (2006.01)

(52) U.S. Cl.
USPC ..... 187/295; 187/288; 187/294; 187/393

(58) Field of Classification Search ..... 187/247, 187/286, 287, 288, 293–297, 305, 391–393
See application file for complete search history.

(56) References Cited

U.S. PATENT DOCUMENTS 3,785,463 A * 1/1974 Kuhl et al. ..... 187/295
4,220,222 A * 9/1980 Kamaike et al. ..... 187/290
4,278,150 A * 7/1981 Wehrli et al. ..... 187/293
4,570,755 A * 2/1986 Tsai et al. ..... 187/284
4,586,587 A * 5/1986 Grossi et al. ..... 187/293
4,751,984 A * 6/1988 Williams et al. ..... 187/293
4,785,914 A * 11/1988 Blain et al. ..... 187/280
6,032,761 A * 3/2000 Coste et al. ..... 187/294
7,533,763 B2 * 5/2009 Kattainen et al. ..... 187/394

(Continued)

FOREIGN PATENT DOCUMENTS

DE 103 92 710 T5 9/2005
EP 1 688 383 A1 8/2006

(Continued)

OTHER PUBLICATIONS

Notification for Submission of Argument issued Dec. 27, 2011 in Korean Patent Application No. 10-2010-7013995 (with English translation).

(Continued)

*Primary Examiner* — Anthony Salata
(74) *Attorney, Agent, or Firm* — Oblon, Spivak, McClelland, Maier & Neustadt, L.L.P.

(57) ABSTRACT

An elevator system includes a car traveling up and down along a hoistway; a buffer for stopping the car at an end of the hoistway; brakes for braking travel of the car; a car traveling-information acquisition mechanism for acquiring information as to speed of the car; and a brake control unit for controlling the brake by comparing a speed of the car with a speed pattern curve created based upon a speed curve of the car when braking force is forcedly exerted by the brakes to enable the buffer to absorb a shock at the collision of the car with the buffer to a level below a predetermined specified value.

9 Claims, 4 Drawing Sheets

U.S. PATENT DOCUMENTS

| | | | | |
|---|---|---|---|---|
| 7,686,139 | B2 | 3/2010 | Kondo et al. | |
| 8,230,977 | B2 * | 7/2012 | Thumm et al. | 187/247 |
| 2007/0227828 | A1 | 10/2007 | Kinpara et al. | |
| 2009/0229924 | A1 | 9/2009 | Kondo et al. | |
| 2009/0255764 | A1 | 10/2009 | Ueda et al. | |
| 2010/0101896 | A1 | 4/2010 | Ueda et al. | |
| 2011/0011681 | A1 * | 1/2011 | Kondo et al. | 187/247 |
| 2012/0061189 | A1 * | 3/2012 | Imfeld et al. | 187/350 |

FOREIGN PATENT DOCUMENTS

| | | | |
|---|---|---|---|
| EP | 1 864 936 | A1 | 12/2007 |
| JP | 7 206288 | | 8/1995 |
| JP | 8 259140 | | 10/1996 |
| JP | 8-259140 | A | 10/1996 |
| JP | 2006 306517 | | 11/2006 |
| JP | 2006-306517 | | 11/2006 |
| JP | 2007 84239 | | 4/2007 |
| JP | 2007-84239 | | 4/2007 |
| WO | 2006 046295 | | 5/2006 |

OTHER PUBLICATIONS

U.S. Appl. No. 13/376,643, filed Dec. 7, 2011, Kondo, et al.

German Office Action issued on Feb. 29, 2012 in corresponding German Application No. 11 2007 003 745.8 (with an English Translation).

U.S. Appl. No. 12/740,371, filed Apr. 29, 2010, Kondo, et al.

Chinese Office Action issued Jul. 18, 2012, in China Patent Application No. 200780102071.0 (with English Translation).

Japanese Office Action Issued Nov. 20, 2012 in Patent Application No. 2009-547820 (with English translation).

* cited by examiner

ELEVATOR SYSTEM HAVING BRAKE CONTROL

FIELD OF THE INVENTION

The present invention relates to an elevator system that is equipped with a brake system for braking its car in emergency.

BACKGROUND ART

A conventional brake system for braking an elevator car has been disclosed in JP H07-206288A. In the disclosed elevator system, its brake control means can prevent the car from colliding with a hoistway end by increasing a deceleration value of the car when approaching near a terminal floor in an emergency stop mode Patent Document 1: JP H07-206288A

DISCLOSURE OF THE INVENTION

Problem that the Invention is to Solve

Although the elevator system is able to prevent the car from colliding with the hoistway ends and ensures passengers' safety as long as a shock at a collision of the car with the buffer is within a specified value, the deceleration value of the car may sometimes become larger than it needs to be, which brings about a problem of causing passengers in the car to feel uncomfortable.

The present invention is aimed at providing a brake system in which a shock at a collision of the car with a buffer installed on the elevator shaft end is absorbed to a level below a specified value.

Means for Solving the Problem

An elevator system according to the present invention includes a car traveling up and down along a hoistway; a buffer for stopping the car at an end of the hoistway; a brake for braking travel of the car; a car traveling-information acquisition means for acquiring information as to speed of the car; and a brake control unit for controlling the brake by comparing a speed of the car with a speed pattern curve created based upon a speed curve of the car when braking force is forcedly exerted by the brake to enable the buffer to absorb a shock at the collision of the car with the buffer to a level below a predetermined specified value.

Effect of the Invention

According to the invention, an elevator system includes a car traveling up and down along a hoistway; a buffer for stopping the car at an end of the hoistway; a brake for braking travel of the car; a car traveling-information acquisition means for acquiring information as to speed of the car; and a brake control unit for controlling the brake by comparing a speed of the car with a speed pattern curve created based upon a speed curve of the car when braking force is forcedly exerted by the brake to enable the buffer to absorb a shock at the collision of the car with the buffer to a level below a predetermined specified value. Therefore, slow stopping of the car can be realized.

REFERENCE NUMERALS

1: elevator car, 2: counterweight, 3: hoist rope, 4: sheave, 5: elevator control unit, 6: hoist motor, 7: brake pulley, 8: brake lining, 9: brake lining, 10: brake control unit, 11: hoist-motor encoder, 12: brake coil, 13: brake coil, 14: governor, 15: buffers, 16: brake control unit, 18: safety state determination part, 18*a*: deceleration calculating part, 18*b*: determination part, 18*c*: storage unit, 19: control command part, 20: relay, 21: relay, 118: safety state determination part, 118*a*: speed versus remaining distance calculating part, 118*b*: determination part, 119: control command part, 22: weighing device

BEST MODE FOR CARRYING OUT THE INVENTION

Embodiment 1

Figure 1:
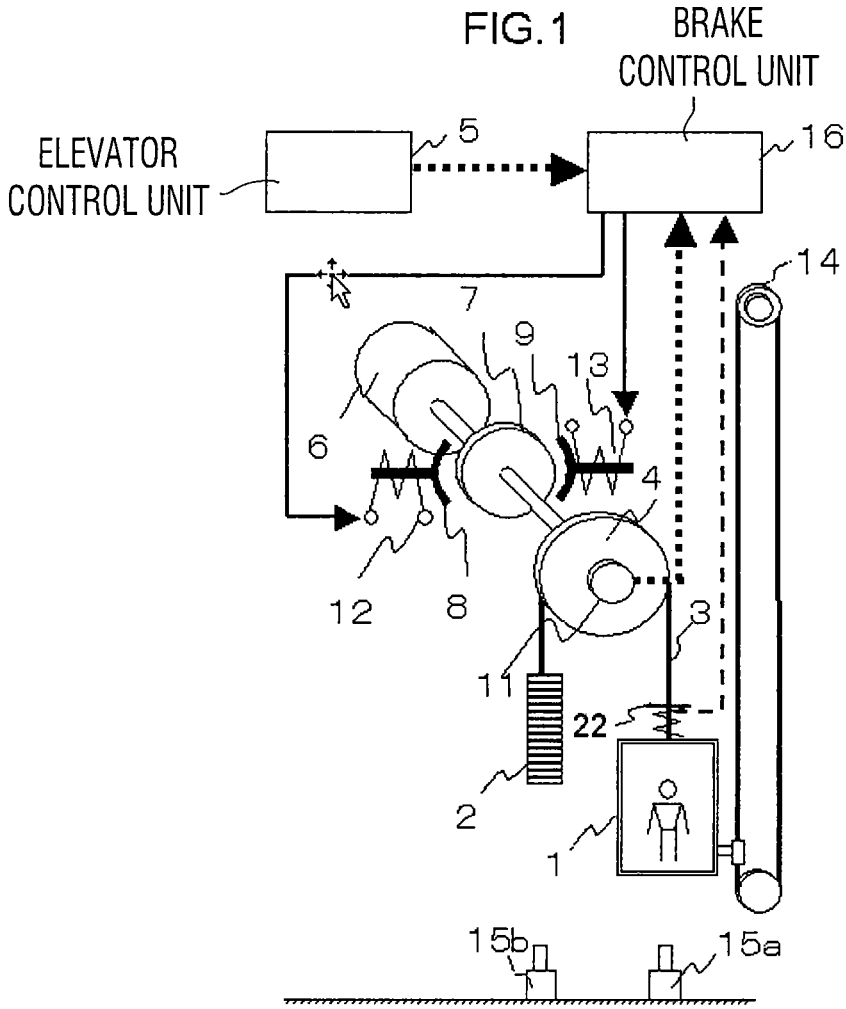
FIG. 1 is a configuration view of an elevator system of Embodiment 1.

An overall configuration of an elevator system in this embodiment will be described with reference to FIG. 1. A car 1 and its counterweight 2 that travel up and down along the hoistway are connected with each other by a hoist rope 3 entrained around a traction sheave 4 that is rotatably driven by a hoist motor 6. In normal operation, the hoist motor 6 rotates the sheave 4 according to a command from an elevator control unit 5 and drives the hoist rope 3 by friction generated between the sheave 4 and the hoist rope 3 to travel the car 1 and the counterweight 2 connected by the hoist rope 3.

In the brake system, a brake pulley 7 that is fixed to the sheave 4 and rotated is pressed by brake linings 8 and 9 by biasing of elastic members of brake springs. Friction force is thereby generated between the brake pulley 7 and the brake linings 8, 9, so that the brake linings 8 and 9 brake the brake pulley 7. With this braking operation, the hoist motor 6 and the sheave 4 are also braked; and hence, the car 1 and the counterweight 2 are stopped.

During normal traveling, the brake linings 8 and 9 are spaced apart from the brake pulley 7 by electromagnetic force, so as to exert no braking force on the brake pulley 7.

On the other hand, upon the elevator coming into an emergency stop mode, a brake control unit 16 receives (i) a command to brake the brake pulley 7 (hereinafter, referred to as emergency stop command) to stop the car 1, from the elevator control unit 5 that governs operation of the elevator because the elevator is in a state that requires a halt of its operation, and (ii) information as to a traveling state of the car 1 (hereinafter referred to as traveling state information), such as a position, a speed, and a weight of the car 1, from a car traveling-information acquisition means including a hoist-motor encoder 11, a governor 14, or a position sensor. Based on the information, the brake control unit then adjusts the pressing force of the brake linings 8 and 9 exerted on the brake pulley 7 by applying a voltage to brake coils 12 and 13. While here described is a case where the brake control unit 16 directly stops the car 1 slowly, the present invention is not limited to this case but includes a case where slow stopping of the car 1 is made indirectly by slowly stopping the counterweight 2. In this case, a deceleration value of the counterweight 2 is calculated based on information from the car traveling-information acquisition means or a counterweight traveling-information acquisition means in place thereof, to keep up with a target deceleration value.

On the bottom of the elevator shaft, a car buffer 15*a* is provided for downward traveling of the car 1 (a counterweight buffer 15*b* for upward traveling). Even if the car 1 cannot be stopped after passing either terminal floor, the car 1 can avoid colliding with the hoistway ends because the car comes into contact with the car buffer 15*a* (or the counterweight buffer 15*b* in a case of upward traveling) and a shock that would be generated at the collision is thereby absorbed. While the description will be made below for a case where the car 1 travels downwardly and then stops by colliding with the car buffer 15*a*, the present invention is not limited to this case. The invention also includes a case where the car 1 travels upwardly and then stops by collision of the counterweight 2 with the counterweight buffer 15*b*.

The buffers 15 here are devices that serve to stop the car 1, if it rushes through either terminal floor, without posing a severe shock by being in contact with the car 1 before it reaches a hoistway end. However, if the car 1 collides with the buffer 15*a* with an unexpected high speed, the car 1 will be subject to a large shock for ensuring safety that the car must be stopped within the limited distance from a contact point with the buffer 15*a* to the hoistway end. For that reason, the buffers 15 have respective predetermined speeds (hereinafter, "specified speed(s)) depending on their capabilities, below which speeds a shock at a collision can be absorbed to a level within a specified value. Hence, a speed at a collision of the car 1 with the buffer 15*a* (hereinafter, "collision speed") must be lower than the specified speed. While this embodiment is described taking the specified speed as a base, the present invention is not limited to this speed. Another predetermined speed lower than the specified speed may be employed as a base in order to pursue a slower stopping. Note that a specified speed for the buffer 15*b* is calculated taking into account a shock to which the car 1 is subjected when the counterweight 2 collides with the buffer 15*b*.

Figure 2:
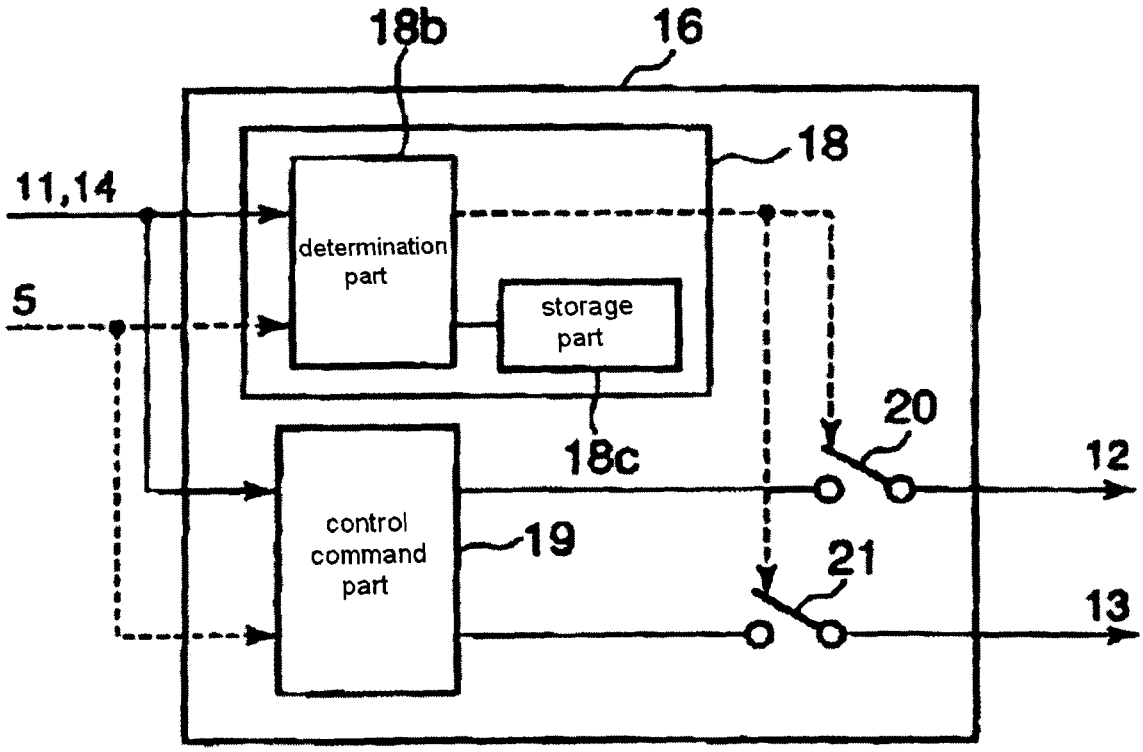
FIG. 2 is a configuration diagram of a brake control unit of Embodiment 1.

A configuration of the brake control unit 16 will be described in detail with reference to FIG. 2. The brake control unit 16 receives signals indicative of (i) an emergency stop command and (ii) traveling state information, to apply to the brake coils 12 and 13 a voltage based on both signals. The brake control unit 16 is configured with a safety state determination part 18, a control command part 19, and safety relays 20 and 21. The safety state determination part 18 is composed of a determination part 18*b* and a storage part 18*c*. The storage part 18*c* stores a plurality of speed pattern curves corresponding to time variations of car speed such as the line L2 in the graph (b) of FIG. 3.

Next, operation of the elevator system in this embodiment will be briefly described. If the elevator is in an emergency stop mode, both signals of (i) an emergency stop command and (ii) traveling state information are transferred to the safety state determination part 18 and the control command part 19 of the brake control unit 16.

The control command part 19 outputs a voltage to be applied to the brake coils 12 and 13, based upon the both signals of (i) the emergency stop command and (ii) the traveling state information, in order to brake the car 1.

The safety state determination part 18 commands open and close of the safety relays 20 and 21, taking into account a speed of the car 1. Namely, the safety state determination part 18 selects one of the plurality of speed pattern curves having been stored in the storage part 18*c*, based upon a speed of the car 1 obtained from the traveling state information at the beginning of an emergency stop mode, and the determination part 18*b* determines whether or not the car 1 is in a traveling state to be decelerated.

Specifically, by comparing a speed on the selected speed pattern curve varying along the speed pattern curve from the beginning of the emergency stop mode with an actual speed of the car 1 obtained from the traveling state information, if the actual speed of the car 1 is higher than the speed on the speed pattern curve, then the safety relays 20 and 21 are opened to put the brake into a state unable to weaken braking force exerted on the brake pulley 7 by the brake linings 8 and 9. On the other hand, if the actual speed of the car 1 obtained from the traveling state information is lower than the speed on the speed pattern curve, the safety relays 20 and 21 are closed to put the brake into a state able to weaken the braking force exerted on the brake pulley 7 by the brake linings 8 and 9. That is, the determination to open or close the safety relays 20 and 21 is made depending on whether or not the car 1 is in a state within the brake-controllable region shown in the graph (b) of FIG. 3 (the brake-controllable region is a region where speeds are lower than a speed pattern curve).

A detail description as to the safety state determination part 18 will be made with reference to FIG. 3. Each graph in FIG. 3 shows state variations of the car 1: the graph (a) shows a time variation of braking force, the graph (b) time variations of car speed, and the graph (c) a time variation of car position.

An elevator system is generally designed so as to reduce a collision speed to below a self-regulated speed even in a case of a car 1 traveling downwardly with a maximum load weight (most difficult condition for deceleration), by deceleration using a braking method (forced braking) in which braking force is unable to be weakened by opening a safety relay to forcedly interrupt energization of a brake coil. The solid line L1 in the graph (b) of FIG. 3 is a speed curve that indicates that a collision speed is reduced below the self-regulated speed by applying a forced braking in a case of the car 1 traveling downwardly with a maximum load weight. It is noted that since the elevator system is generally designed, as described above, so as to reduce a collision speed to below the self-regulated speed by deceleration by the forced braking, a remaining distance that is a distance from the car 1 to the buffer 15*a* is larger than the area A shown in the graph (b) of FIG. 3.

Figure 3:
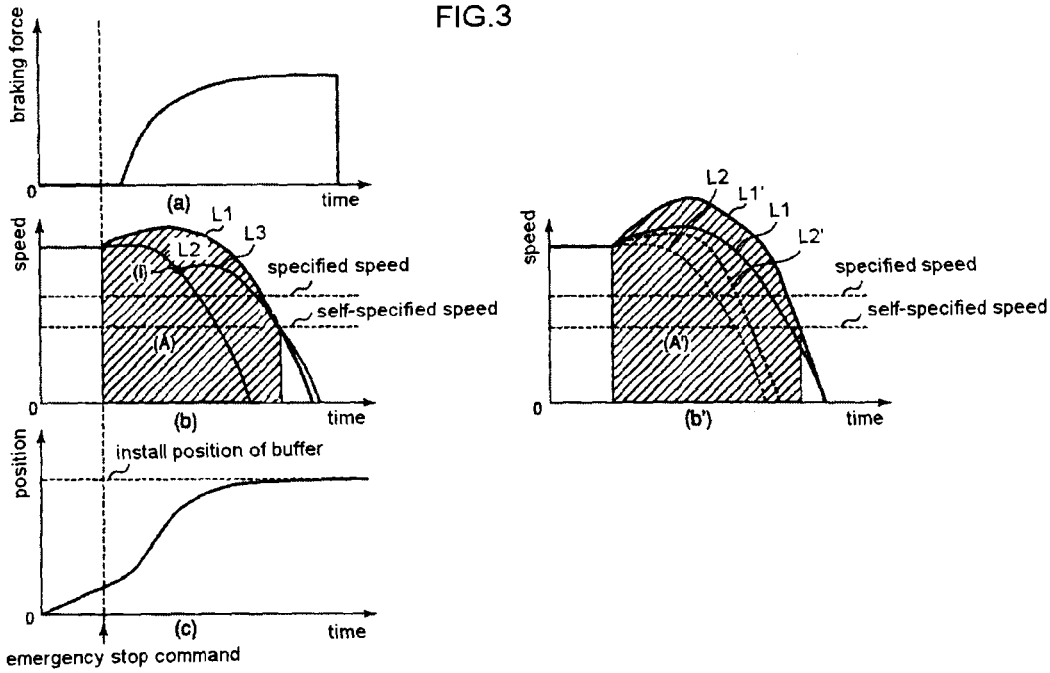
FIG. 3 shows graphs of (a) a time variation of braking force, (b) time variations of car speed, and (c) a time variation of car position, in Embodiment 1.

In determining whether to open or close the safety relays 20 and 21, if a speed of the car 1 is within the brake-controllable region shown in the graph (b) of the FIG. 3, the brake is put into the state able to weaken its braking force. For example, in a case of the car 1 coming into a state of a point (i) on the brake-controllable region boundary L2, if increasing the braking force, the car is decelerated along such a speed curve L3. In other words, the brake-controllable region boundary L2 is a speed pattern curve that enables a collision speed of the car 1 to be reduced below the self-regulated speed by the forced braking if the car 1 is in a state on the boundary.

The brake-controllable region boundary L2 is calculated through the following procedure. While the solid line L1, which is a speed curve, is firstly calculated, the speed variation along the solid line L1 is calculated by Eqn. (1) below, under a load weight that is a most difficult for the car 1 to be decelerated. Next, the boundary is determined through the following steps.

(A) In the same manner as for the solid line L1, a speed variation curve is plotted as a dotted line L2 by appropriately varying the load weight (by a certain fixed value) from the most difficult condition for deceleration to an easier condition for deceleration (This condition is defined as current condition.).

(B) Decelerating speed variation curves (corresponding to the curve L3) are plotted from any given points on the dotted line L2 under the current condition.

(C) If every line plotted in the step (B) has lower speeds than the solid line L1 has, then the line L2 is determined to be a boundary of the brake-controllable region.

(D) If at least one of the lines plotted in the step (B) has a higher speed than the solid line L1 has, then the operation of the step (A) is carried out by further decreasing appropriately the load weight (by the fixed value determined before).

$$\left.\begin{array}{l} v_0 - \int \frac{F(t) - F_2}{m} dt > 0 \text{ の場合 } V(t) = v_0 - \int \frac{F(t) - F_2}{m} dt \\ v_0 - \int \frac{F(t) - F_2}{m} dt \leq 0 \text{ の場合 } V(t) = 0 \end{array}\right\} \quad \text{Eqn. (1)}$$

In Eqn. (1), m represents a total inertia mass of the elevator, F(t) braking force by the brake, and F2 accelerating force due to weight difference between the car 1 and the counterweight 2. Moreover, a speed $v_0$ of the car 1 represents a speed at the beginning of an emergency stop mode and time t is defined from the beginning of the emergency stop mode as a reference time of zero. Additionally, time variations of speed such as indicated by the solid line L3 can also be calculated by changing the definitions of some constants in Eqn. (1). In this calculation, the speed $v_0$ of the car 1 is defined as a speed at a given point below the solid line L1 and the time t is defined from a reference time of zero at the given point.

When a speed of the car 1 is within the brake-controllable region, the braking force exerted on the brake wheel 7 is weakened, because a load condition being easier for deceleration than the load condition under which the boundary L2 of the brake-controllable region is determined as long as the control is performed within the brake-controllable region. Hence, if the speed of the car 1 exceeds the boundary L2 of the brake-controllable region at the point (i), a speed variation that is most difficult for deceleration among speed variations decelerated by the forced braking is the solid line L3. Since the boundary L2 of the brake-controllable region is determined so that a solid line L3 never exceeds the speed of the solid line L1 at any time, a speed variation of the solid line L3 after extending out of the brake-controllable region does not exceed the solid line L1 by deceleration by the forced braking. Therefore, the car 1 is decelerated more quickly than is decelerated by the forced braking from the beginning of an emergency stop mode under a most difficult condition for the car 1 to be decelerated.

While this embodiment has been described in which the solid line L1 is a speed variation curve of deceleration by the forced braking under a most difficult condition for deceleration, the present invention is not limited to this. Namely, the speed curve may be a speed variation curve along which the car 1 can be decelerated within a remaining distance from a speed at the beginning of an emergency stop mode to the self-regulated speed under the most difficult condition for decelerating the car 1. In other words, under the most difficult condition for decelerating the car 1, if there is a sufficient remaining distance (which information is acquired from the car traveling information acquisition means) compared to the distance required for deceleration to the self-regulated speed from a speed at the beginning of an emergency stop mode, a speed curve L1' (shown in the graph (b') of FIG. 3) is sometimes defined that is higher than the solid-line speed curve L1 in the graph (b) of FIG. 3. In this case, the area A can be extended to the area A', i.e., the car 1 can be stopped more slowly.

Moreover, while this embodiment has been described in which a speed of the car 1 is compared with a corresponding speed on a speed pattern curve stored in the storage part 18*c*, the present invention is not limited to this. Namely, the brake control unit 16 may create a speed pattern curve, based on an actual state of the car 1, to compare a speed of the car 1 with the speed pattern curve.

Figure 4:
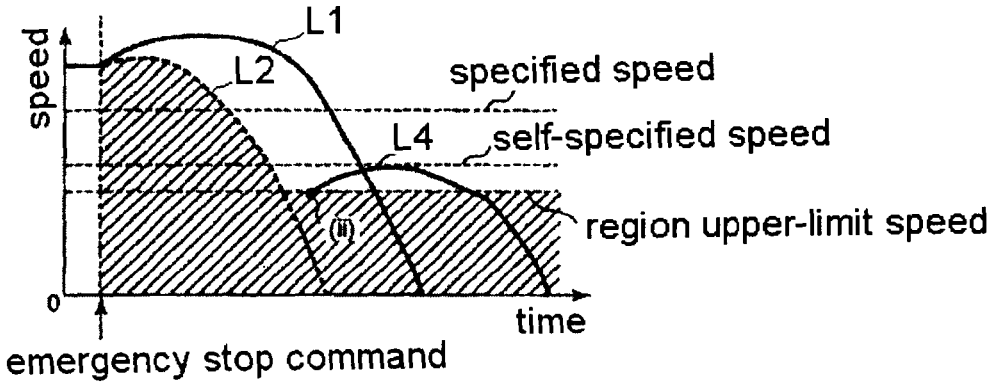
FIG. 4 is another graph of time variations of car speed, in Embodiment 1.

In this embodiment, another speed pattern curve is sometimes created taking into account a region having a region upper-limit speed, as shown in FIG. 4, below which the car speed never increases to the self-regulated speed under a forced deceleration. The region upper-limit speed is defined as a speed that is lower than the self-regulated speed and never brings the car to reach the self-regulated speed when decelerating by the force braking even under a difficult condition for deceleration. For example, a speed curve that exceeds the region upper-limit speed at the point (ii) under a difficult condition for deceleration never exceeds the self-regulated speed. The region upper-limit speed is calculated as Vc from the following equation:

$$\left.\begin{array}{l} \frac{F(t0) - F_2'}{m} = 0 \\ Vc = vb + \int_0^{t0} \frac{F(t) - F_2'}{m} dt \end{array}\right\}, \quad \text{Eqn. (2)}$$

where each variable and constant is defined with respect to the car 1, and m represents a total inertia mass, F(t) braking force of the brake, F2' a maximum accelerating force at a maximum weight difference between the car 1 and the counterweight 2, and vb the self-regulated speed. A time t0 represents the time when the F(t) and F2' cancel out each other.

Embodiment 2

A method is described in Embodiment 1 in which a speed of the car 1 is detected to determine whether to open or close the safety relays 20 and 21 and to command open or close thereof so that a collision speed is reduced to the self-regulated speed even under a difficult condition for decelerating the car 1. In Embodiment 2, a traveling direction and a load condition of the car 1 are detected to extend conditions allowable for the braking force to be weakened by closing the safety relays 20 and 21. With the extended conditions allowable for weakening the braking force, it is possible to reduce frequency of sudden stopping by the forced braking. Note that the load condition and the traveling direction of the car 1 are detected by, for example, a weighing device 22 and the hoist-motor encoder 11, respectively.

Figure 5:
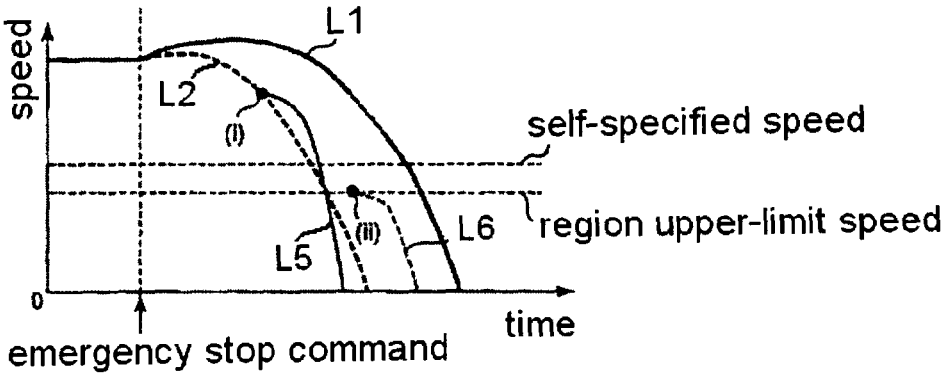
FIG. 5 is time variations of car speed, in Embodiment 2.
Figure 6:
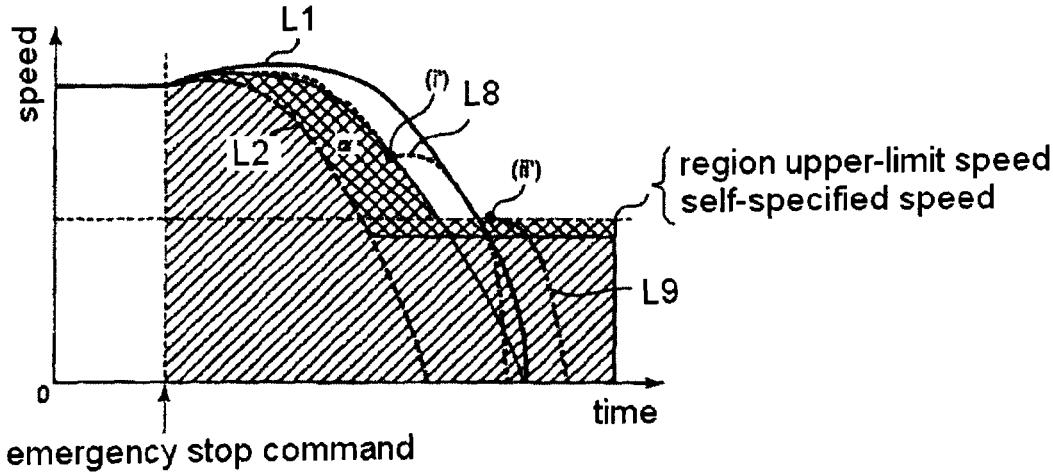
FIG. 6 is another graph of graph of time variations of car speed, in Embodiment 2.

In a case of a car speed exceeding the boundary of the brake-controllable region under a load condition and a traveling direction for easily braking the car 1, the speed varies with time along a speed curve L5 or L6 shown in FIG. 5. Thus, there is a margin between the solid line L1, and the curve L5 or L6. Accordingly, when the car 1 is determined, by detecting its load condition and traveling direction, to be in a state easy to be stopped, the brake-controllable region can be extended further. When the easily stopping load condition is detected, the brake-controllable region can be further extended to include, for example, the crosshatched region α as shown in FIG. 6. Even if a car speed is on the boundary of the brake-controllable region at a point (i') or (ii'), a speed curve expressing a state variation from the point is plotted as the curve L8 or L9 and always remains below the solid line L1. In addition, the boundary of the brake-controllable region including the crosshatched region α is defined as plots of reference points having maximum speeds among given reference points of speed variation curves that vary always below the solid line L1 or the self-regulated speed, among those curves plotted against time from any given reference points such as the point (i') and (ii').

While this embodiment is described in which the speed pattern curves are plotted based on load weights and traveling directions in order to extend the brake-controllable region, the present invention is not limited to this. Namely, the brake-controllable region can also be extended by taking into account either one of the load weights and the traveling directions.

Embodiment 3

In this embodiment, the safety state determination part 18 determines, based on (i) a speed of the car 1 and (ii) a deceleration value of the car 1, whether a collision speed can be decelerated below the self-regulated speed, to command open or close of the safety relay 20 and 21. The deceleration value of the car 1 is obtained from the car traveling-information acquisition means such as the hoist-motor encoder 11, the governor 14, or the position sensor.

Figure 7:
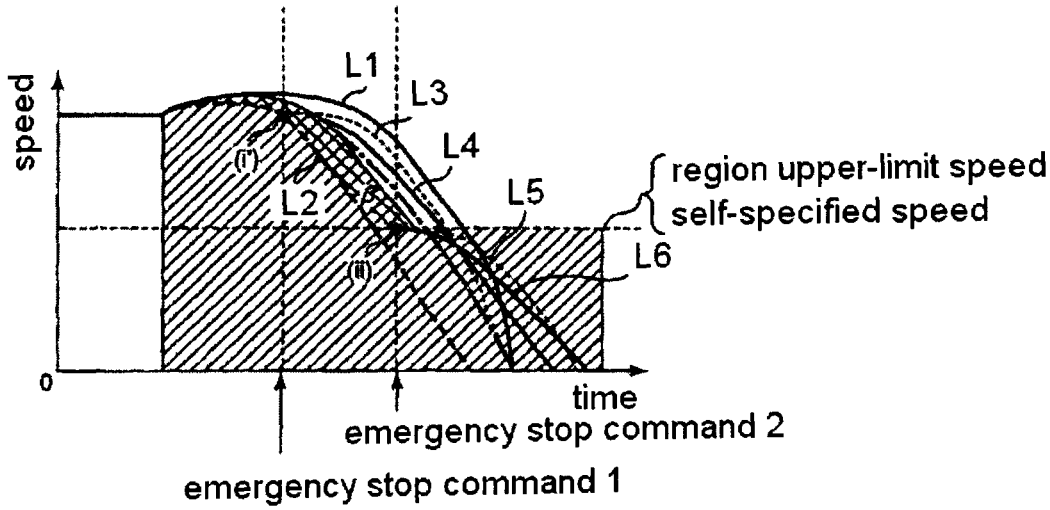
FIG. 7 is a graph of time variations of car speed, in Embodiment 3.

The solid line L1 in FIG. 7 is a speed variation curve of deceleration by the forced braking under a most difficult condition for deceleration. Speed varying below the time varying speed of the solid line L1 leads to reduction of a collision speed to below the self-regulated speed.

In determining whether to open or close the safety relays 20 and 21, the safety state determination part 18 allows control of the braking force to be weakened only when simultaneously satisfied are requirements: (i) the speed of the car 1 is within the hatched brake-controllable region in FIG. 6 and (ii) the car 1 is in a decelerating state.

It is assumed here that the requirements (i) and (ii) are simultaneously satisfied when the elevator falls into an emergency stop mode. Then, the safety relays 20 and 21 must be closed. In this case, if a weight difference between the car 1 and the counterweight 2 acts to accelerate the car 1 downwardly because of the car 1 being larger in weight than the counterweight 2, the brake linings 8 and 9 should already exert the braking force on the brake wheel 7. This is due to the fact that the state of the car is in contradiction to the requirement (ii), because the car would not be in a decelerating state if the braking force were not exerted. For that reason, in the start operation of the forced braking to decelerate the car from such a state by opening the safety relays 20 and 21, there is no need to make allowance for a coasting time period during which the braking force does not act until the brake linings 8 and 9 are put into contact with the brake wheel 7.

Contrarily, in a case of a state in which a weight difference between the car 1 and the counterweight 2 acts to accelerate the car 1 upwardly because of the car 1 not being larger in weight than the counterweight 2, even if the brake linings 8 and 9 do not exert the braking force on the brake wheel 7, the car is accelerated upwardly, i.e., decelerated in the traveling direction. In this case, the brake linings 8 and 9 may not be in contact with the brake wheel 7. For that reason, in the start operation of the forced braking to decelerate the car from such a state by opening the safety relays 20 and 21, if a more difficult condition for deceleration is presumed, there is a need to make allowance for the coasting time period during which the braking force is not exerted until the brake linings 8 and 9 are put into contact with the brake wheel 7.

Hence, in performing the forced braking by opening the safety relays 20 and 21, a collision speed becomes maximal (i) when the brake is applied by making allowance for the coasting time period in a case of the car 1 not being accelerated downwardly or (ii) when the brake is applied by making no allowance for the coasting time period in a case of the car 1 being accelerated downwardly.

In FIG. 7, the doted lines L3 and L5 plotted from reference points (i') and (ii), respectively, are speed variation curves when applying the forced braking without making allowance for the coasting time period under the condition of no weight difference force, and the solid lines L4 and L6 are speed variation curves when applying the forced braking without making allowance for the coasting time period under the condition of a weight difference force that acts in a direction for most accelerating the car. A boundary of the brake-controllable region is defined as plots of reference points having maximum speed among those points of speed curves that vary always within the region below the solid line L1, among such speed-versus-time variation curves plotted by varying the reference time that have possibilities to have maximum collision speeds. With the boundary thus defined, the brake-controllable region can be extended to the crosshatched region β, thereby maximizing the brake-controllable region. One example of specific steps of determining the boundary of the brake-controllable region is described below in accordance with the above-mentioned procedure.

(A) The solid line L1 is plotted against time from a reference time of zero on the speed-time plane for comparison.

(B) In the same way, time variation curves from given reference points such as the points (i') and (ii) are plotted against time from a reference time of zero on the speed-time plane. In doing so, the curves are plotted by appropriately increasing (by a certain fixed increment) reference speeds from zero, and the every plotted curve from the reference points such as the points (i') and (ii) is compared in magnitude with the solid line L1. From the comparison result, a reference point having maximum speed among those points, such as the points (i') and (ii), of the plotted time-variation curves that vary below the solid line L1 is defined as a boundary point of the brake-controllable region at the reference time.

(C) By appropriately increasing the reference time (by a certain fixed value) in the step (B), boundary points of the brake-controllable region at each reference time are plotted, so that the boundary of the brake-controllable region is determined as plots of these points.

In this embodiment, by thus introducing condition determination that the car 1 is in a decelerating state, the brake-controllable region can be extended compared to Embodiment 1 and Embodiment 2, thereby enhancing the effect of extending controllable conditions.

Moreover, applying the requirements (i) and (ii) of this embodiment in an easy-to-brake load condition, the brake-controllable region can be extended to include the crosshatched region β shown in FIG. 7.

What is claimed is:

1. An elevator system comprising:

a car traveling up and down along a hoistway;

a buffer for stopping the car at an end of the hoistway;

a brake for braking travel of the car;

a car traveling-information acquisition means for acquiring information as to speed of the car; and a brake control unit for controlling the brake by switching between a forced braking state in which the braking force is not able to be weakened and a state in which the braking force is able to be weakened, by comparing a speed of the car with a speed pattern curve created based upon a speed curve of the car upon the elevator coming into an emergency stop mode, to enable the buffer to absorb a shock at the collision of the car with the buffer to a level below a predetermined specified value.

2. An elevator system comprising:

a car traveling up and down along a hoistway;

a buffer for stopping the car at an end of the hoistway;

a brake for braking travel of the car;

a car traveling-information acquisition means for acquiring information as to speed of the car and information as to distance between the car and the buffer; and a brake control unit including a speed pattern curve storage means for storing a plurality of speed pattern curves created based upon speed curves of the car upon the elevator coming into an emergency stop mode, to enable the buffer to absorb a shock at the collision of the car with the buffer to a level below a predetermined specified value, for controlling the brake by comparing a speed of the car with a speed pattern curve selected based on the speed information and distance information acquired from the car traveling-information acquisition means from the speed pattern curve storage means.

3. The elevator system of claim 1, wherein the speed pattern curve is created further based on distance between the car and the buffer.

4. The elevator system of claim 1 , wherein the car traveling-information acquisition means further acquires information as to a load weight of the car, and the speed pattern curve is created further based on load weight of the car.

5. The elevator system of claim 1, wherein the car traveling-information acquisition means further acquires information whether the car is decelerating or not, and the speed pattern curve is created further based on whether the car is decelerating or not.

6. An elevator system comprising:

a counterweight traveling up and down along a hoistway;

a buffer for stopping the counterweight at an end of the hoistway;

a brake for braking travel of the counterweight;

a counterweight traveling-information acquisition means for acquiring information as to speed of the counterweight; and a brake control unit for controlling the brake by switching between a forced braking state in which the braking force is not able to be weakened and a state in which the braking force is able to be weakened, by comparing a speed of the counterweight with a speed pattern curve created based upon a speed curve of the counterweight upon the elevator coming into an emergency stop mode, to enable the buffer to absorb a shock at the collision of the counterweight with the buffer to a level below a predetermined specified value.

7. The elevator system of claim 2, wherein the speed pattern curve is created further based on distance between the car and the buffer.

8. The elevator system of claim 2, wherein the car traveling-information acquisition means further acquires information as to a load weight of the car, and the speed pattern curve is created further based on load weight of the car.

9. The elevator system of claim 2, wherein the car traveling-information acquisition means further acquires information whether the car is decelerating or not, and the speed pattern curve is created further based on whether the car is decelerating or not.

* * * * *